United States Patent [19]

Mitsuda et al.

[11] 4,271,667

[45] Jun. 9, 1981

[54] APPARATUS FOR CONTROLLING THE AMOUNT OF SECONDARY AIR FED INTO AN INTERNAL COMBUSTION ENGINE

[75] Inventors: Tadao Mitsuda; Minoru Iwata, both of Susono; Masatoshi Sugiura; Shigetaka Takada, both of Obu; Yukihiro Watanabe, Nagoya, all of Japan

[73] Assignees: Toyota Jidosha Kogyo Kabushiki Kaisha; Aisan Industry Co., Ltd., both of Aichi, Japan

[21] Appl. No.: 960,654

[22] Filed: Nov. 14, 1978

[30] Foreign Application Priority Data

Nov. 29, 1977 [JP] Japan ..... 52/142162

[51] Int. Cl.[3] ..... F01N 3/10

[52] U.S. Cl. ..... 60/276; 60/289; 60/290; 123/440; 123/589

[58] Field of Search ..... 60/276, 289, 290; 123/32 EE, 119 EC, 124 R, 124 B, 119 D, 119 DB, 440, 589, 489

[56] References Cited

U.S. PATENT DOCUMENTS

| | | | |
|---|---|---|---|
| 3,931,710 | 1/1976 | Hartel | 60/290 |
| 3,962,867 | 6/1976 | Ikeura | 60/290 |
| 3,974,651 | 8/1976 | Nakajima | 60/290 |
| 4,007,718 | 2/1977 | Laprade | 123/119 D |
| 4,010,722 | 3/1977 | Laprade | 123/124 R |
| 4,104,879 | 8/1978 | Nohira | 60/290 |
| 4,137,714 | 2/1979 | Takeda | 60/276 |
| 4,147,030 | 4/1979 | Katahira | 60/276 |

*Primary Examiner*—Douglas Hart

*Attorney, Agent, or Firm*—Stevens, Davis, Miller & Mosher

[57] ABSTRACT

An apparatus for controlling the amount of secondary air fed into an internal combustion engine includes means for controlling the response speed of a secondary air flow control means in accordance with the amount of exhaust gas emitted from the engine. Thus, the equivalent air-fuel ratio can be correctly controlled, without delay, in response to changes in the operating condition of the engine.

9 Claims, 11 Drawing Figures

| Fig. 4 A |
| --- |
| Fig. 4 B |

APPARATUS FOR CONTROLLING THE AMOUNT OF SECONDARY AIR FED INTO AN INTERNAL COMBUSTION ENGINE

BACKGROUND OF THE INVENTION

The present invention relates to an apparatus for controlling the amount of secondary air fed into an intake passage or into an exhaust passage of an internal combustion engine for controlling an equivalent air-fuel ratio (if an air-fuel passage from the intake passage through exhaust passage located upstream of an air-fuel ratio sensor is defined as a working fluid passage, the equivalent air-fuel ratio is defined as a ratio of the amount of air fed into the working fluid passage to the amount of fuel fed into the working fluid passage) within a predetermined range.

In the field of this art, a method is known in which the equivalent air-fuel ratio is detected by an air-fuel ratio sensor, for example, an oxygen concentration sensor for detecting the concentration of oxygen in the exhaust gas, and; then, secondary air is fed into an intake passage or into an exhaust passage of an internal combustion engine according to the detected equivalent air-fuel ratio, for maintaining the equivalent air-fuel ratio within a predetermined range which is near the stoichiometric air-fuel ratio, whereby the effect of purifying pollutants in a three-way catalytic converter disposed in the exhaust system is improved.

In a conventional apparatus for carrying out the above-mentioned method, the amount of secondary air to be injected into the engine is controlled by an air flow control valve disposed in a passage between an air pump and a secondary air injection mechanism. The air flow control valve is driven by an actuating pressure applied thereto through an electromagnetic valve which is adapted for switching the transmission of the actuation pressure on or off in response to an electrical signal provided from the air-fuel ratio sensor. More specifically, when a lean signal, which indicates that the equivalent air-fuel ratio is on the lean side of the stoichiometric air-fuel ratio, is provided from the air-fuel ratio sensor, a diaphragm of the air flow control valve is not actuated by the actuating pressure and is pressed by a return spring, so as to form a passage for discharging the air fed from the air pump into the atmosphere. Further, when a rich signal, which indicates that the equivalent air-fuel ratio is on the rich side of the stoichiometric air-fuel ratio, is provided from the air-fuel ratio sensor, the diaphragm of the air flow control valve is actuated by the actuating pressure against the pressing force of the return spring, so as to form a passage for providing the air fed from the air pump to the secondary air injection mechanism. The actuating pressure may be a negative pressure, such as vacuum pressure provided from an intake manifold of the engine, or a positive pressure, such as discharge pressure of the air pump.

However, in the conventional apparatus of the above described type, the electromagnetic valve is simultaneously driven with the electrical signal provided from the air-fuel ratio sensor and, thus, the air flow control valve is controlled regardless of the flow amount of the exhaust gas. Therefore, when a rapid increase of the exhaust gas flow occurs, in other words, when the engine is rapidly accelerated, the operation of the air flow control valve cannot follow such changes of the engine conditions. As a result, it is very difficult to control the equivalent air-fuel ratio within the predetermined range in such a case.

SUMMARY OF THE INVENTION

It is, therefore, an object of the present invention to provide an apparatus for controlling the amount of secondary air fed into an internal combustion engine, whereby the equivalent air-fuel ratio can be correctly controlled, without delay, in response to changes in the operating condition of the engine.

According to the present invention, an apparatus for controlling the amount of secondary air fed into an internal combustion engine comprises: means for generating a first electrical signal of a level which indicates an equivalent air-fuel ratio condition; means for generating a second electrical signal which indicates the amount of the exhaust gas emitted from the engine; means for controlling the amount of secondary air to be fed into the engine, in accordance with the level of actuating pressure applied thereto; a first pressure control means for controlling the level of actuating pressure fed to the above-mentioned means for controlling the amount of secondary air, in response to predetermined levels of the first electrical signal, and; a second pressure control means for controlling the level of actuating pressure fed from the above-mentioned first pressure control means and applied to the above-mentioned means for controlling the amount of secondary air, in accordance with the amount of the exhaust gas flow indicated by the second electrical signal.

The above and other related objects and features of the present invention will be apparent from the following description of the present invention with reference to the accompanying drawings, as well as from the appended claims.

DETAILED DESCRIPTION OF THE INVENTION

Figure 1:
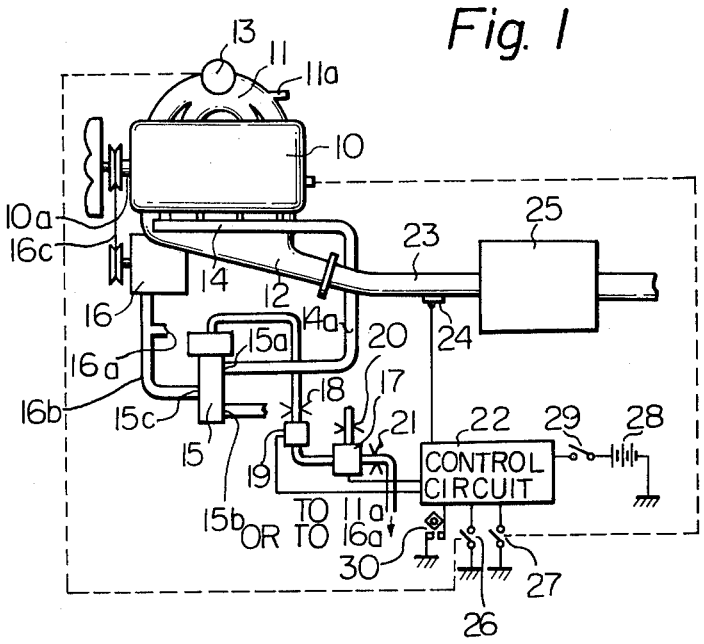
FIG. 1 is a schematic diagram of an internal combustion engine to which an apparatus for controlling the amount of secondary air according to the present invention is attached.

Referring to FIG. 1, which is a schematic diagram of an internal combustion engine having an apparatus according to the present invention, reference numeral 10 represents a body of the engine, 11 represents an intake manifold of the engine 10, 11*a* represents a vacuum take-out port of the intake manifold 11, and 12 represents an exhaust manifold of the engine 10. A carburetor 13 having a throttle valve (not shown) is mounted upstream of the intake manifold 11. A secondary air manifold 14 for injecting secondary air into the exhaust manifold 12 is mounted on the exhaust port portion of the exhaust manifold 12. The secondary air manifold 14 communicates via a conduit 14*a*, with a first port 15*a* of an air flow control valve 15 which is a diaphragm-type three-port valve. A check valve (not shown) is generally mounted on the conduit 14*a*. A second port 15*b* of the air flow control valve 15 is opened to the atmosphere via, for example, an air cleaner (not shown). A third port 15*c* of the air flow control valve 15 communicates via a conduit 16*b*, with the discharge outlet of an air pump 16 which is driven by a crankshaft 10*a* of the engine 10 via a belt 16*c*. A suction inlet (not shown) of the air pump 16 is opened to the atmosphere via, for example, an air cleaner (not shown). A diaphragm chamber in the air flow control valve 15 communicates with a first port of an electromagnetic valve 19 of a two-port valve via an orifice 18.

A second port of the electromagnetic valve 19 communicates with a first port of an electromagnetic valve 17 of a three-port valve. A second port of the electromagnetic valve 17 is opened to the atmosphere via an orifice 20 and preferably through an air cleaner (not shown). A third port of the electromagnetic valve 17 communicates via an orifice 21, with the vacuum take-out port 11*a* or with a positive pressure take-out port 16*a* on the conduit 16*b* for feeding the discharge pressure provided from the air pump 16.

Exciting coils (shown in FIG. 3) of the electromagnetic valves 17 and 19 are electrically connected to a control circuit 22, respectively. The electromagnetic valve 17 is arranged so that when the exciting coil thereof is energized, an actuating pressure provided from the vacuum take-out port 11*a* or from the discharge pressure take-out port 16*a* is applied to the electromagnetic valve 19, and that when the exciting coil is de-energized, atmospheric pressure is applied to the electromagnetic valve 19. The electromagnetic valve 19 is so arranged that when the exciting coil thereof is energized, the actuating pressure or the atmospheric pressure applied thereto is transmitted to the diaphragm chamber of the air flow control valve 15, and that when the exciting coil is de-energized, this transmission is cut off.

An exhaust pipe 23 is connected downstream of the exhaust manifold 12. An air-fuel ratio sensor 24, for example, an oxygen concentration sensor for detecting the equivalent air-fuel ratio is mounted on the exhaust pipe 23. A three-way catalytic converter 25 for reducing the three main pollutants, i.e., $NO_x$, CO and HC components, in the exhaust gas is mounted in the exhaust pipe 23 downstream of the air-fuel ratio sensor 24. The output terminal of the air-fuel ration sensor 24 is electrically connected to the control circuit 22.

A throttle position switch 26 is interconnected with the throttle valve in the carburetor 13 for detecting a specific position of the throttle valve where the opening degree of the value is greater than a predetermined valve. One terminal of the throttle position switch 26 is electrically connected with the control circuit 22 and the other terminal of the switch 26 is grounded. An engine temperature switch 27 is mounted on a cylinder block of the engine 10 for detecting whether or not the engine coolant temperature is less than a predeterminal level. One terminal of the engine temperature switch 27 is electrically connected to the control circuit 22 and the other terminal of the switch 27 is grounded. A positive side terminal of a battery 28 is electrically connected to a power input terminal 22*e* (shown in FIG. 3) of the control circuit 22 through an ignition switch 29, and a negative side terminal of the battery 28 is grounded. One terminal of contact points 30 actuated by a breaker cam which rotates with the crankshaft 10*a* of the engine is electrically connected to the control circuit 22, and the other terminal thereof is grounded.

Figure 2A:
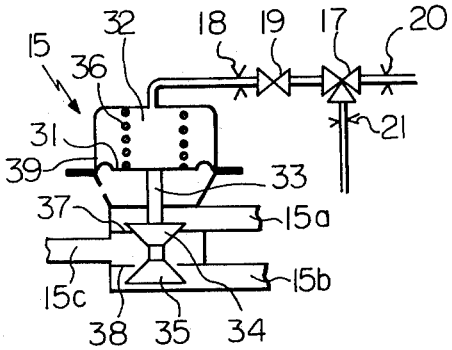
FIGS. 2*a* and 2*b* are schematic sectional diagrams illustrating two respective embodiments of an air flow control valve shown in FIG. 1.

FIG. 2*a* illustrates the structure of the air flow control valve 15 which uses vacuum pressure in the intake manifold 11 as an actuating pressure for driving the diaphragm of the valve 15. In FIG. 2*a*, reference numerals 31 and 32 represent a diaphragm and a diaphragm chamber, respectively. The diaphragm 31 is connected to valve members 34 and 35 by means of a rod 33. The mid portion of the rod 33 is slidably supported by a body 39 of the air flow control valve 15. A diaphragm-return spring 36 is disposed in the chamber 32 for the purpose of pressing against the diaphragm 31. This control valve 15 is so arranged that when the pressure level in the chamber 32 is equal to the atmospheric pressure level, the valve member 34 is rested on a valve seat 37 and the valve member 35 is positioned apart from a valve seat 38, as shown in FIG. 2*a*.

Therefore, when the electromagnetic valve 17 is electrically de-energized and the electromagnetic valve 19 is intermittently energized, since the pressure level in the chamber 32 approaches the atmospheric pressure level, the second port 15*b* is communicated with the third port 15*c*. Contrary to this, when the valve 17 is energized and the valve 19 is intermittently energized, since the vacuum pressure generated in the intake manifold 11 is applied to the chamber 32, the diaphragm 31 is actuated so as to move in a direction opposite to that of the spring force caused by the return-spring 36. Thus, the valve members 34 and 35 are driven to open and to close the valve seats 37 and 38, respectively. As a result, in this case, the first port 15*a* is communicated with the third port 15*c*.

The orifices 18, 20 and 21 are adapted for controlling the driving speed of the diaphragm 31 in cooperation with the electromagnetic valve 19, namely for controlling the speed for transmitting the actuating pressure through each of these orifices, to a desirable speed. The inner cross section of these orifices are determined according to the response speed of the electromagnetic valves 17 and 19.

Figure 2B:
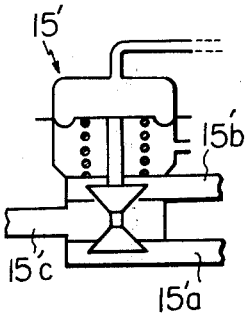

FIG. 2*b* illustrates the structure of another embodiment of the air flow control valve according to the present invention. This air flow control valve 15' has substantially the same function as that of the air flow control valve 15 shown in FIG. 2*a*, except that this control valve 15' is driven by the positive pressure, for example, the discharge pressure of the air pump 16, instead of being driven by the vacuum pressure in the intake manifold 11.

Figure 3:
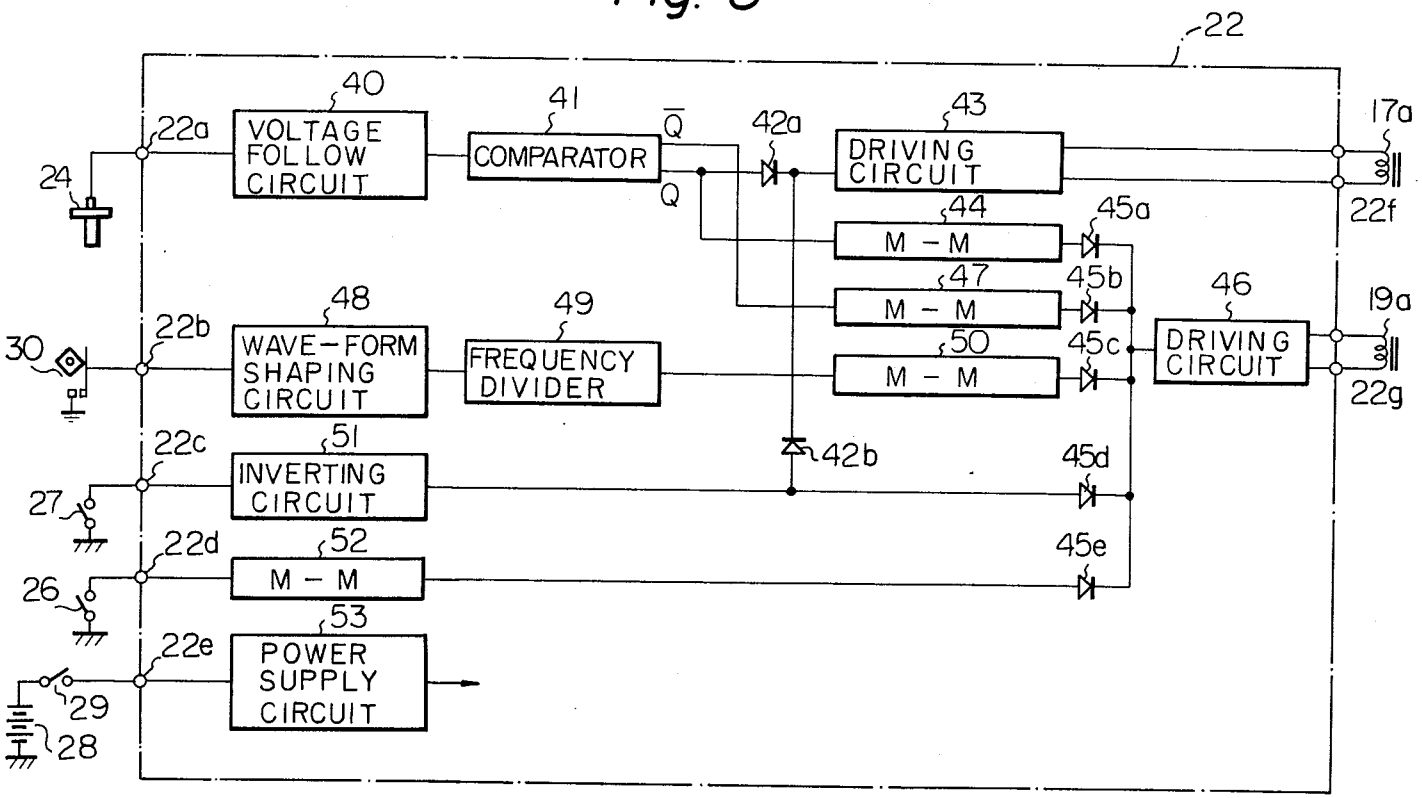
FIG. 3 is a block diagram of a control circuit shown in FIG. 1.

FIG. 3 is a block diagram illustrating the control circuit 22 shown in FIG. 1. As shown in FIG. 3, the output terminal of the air-fuel ratio sensor 24 is connected to the input terminal of a voltage follow circuit 40 through an input terminal 22*a*. The output terminal of the voltage follow circuit 40 is connected to the input terminal of a comparator 41. The output terminal Q of the comparator 41 is connected to the input terminal of a driving circuit 43 through a diode 42*a*. The output terminal of the driving circuit 43 is connected to an exciting coil 17*a* of the electromagnetic valve 17 through an output terminal 22*f*. The output terminal Q of the comparator 41 is also connected to the input terminal of a driving circuit 46 through a first monostable multivibrator 44 and a diode 45*a*. The output terminal of the driving circuit 46 is connected to an exciting coil 19*a* of the electromagnetic valve 19 through an output terminal 22*g*. The other output terminal $\overline{Q}$, namely the inverting output terminal, of the comparator 41 is connected to the input terminal of the driving circuit 46 through a second monostable multivibrator 47 and a diode 45*b*.

One terminal of the contact points 30 is connected to the input terminal of a frequency divider 49 through an input terminal 22*b* and a wave-form shaping circuit 48. The output terminal of the divider 49 is connected to the input terminal of the driving circuit 46 through a third monostable multivibrator 50 and a diode 45*c*.

One terminal of the engine temperature switch 27 is connected to the input terminal of an inverting circuit 51 through an input terminal 22*c*. The output terminal of this inverting circuit 51 is connected to the input terminal of the driving circuit 46 through a diode 45*d*, and to the input terminal of the driving circuit 43 through a diode 42*b*.

One terminal of the throttle position switch 26 is connected to the input terminal of a fourth monostable multivibrator 52 through an input terminal 22*d*. The output terminal of the multivibrator 52 is connected to the input terminal of the driving circuit 46 through a diode 45*e*. The positive side terminal of the battery 28 is connected to the input terminal of a power supply circuit 53 through the ignition switch 29 and an input terminal 22*d*. The output terminal of the power supply circuit 51 is connected to each of the power input terminals of the above-mentioned circuits, respectively. Each of the afore-mentioned groups of diodes 42*a* and 42*b*, and diodes 45*a*, 45*b* and 45*c* forms a kind of OR circuit, respectively.

Figures 4, 4A:
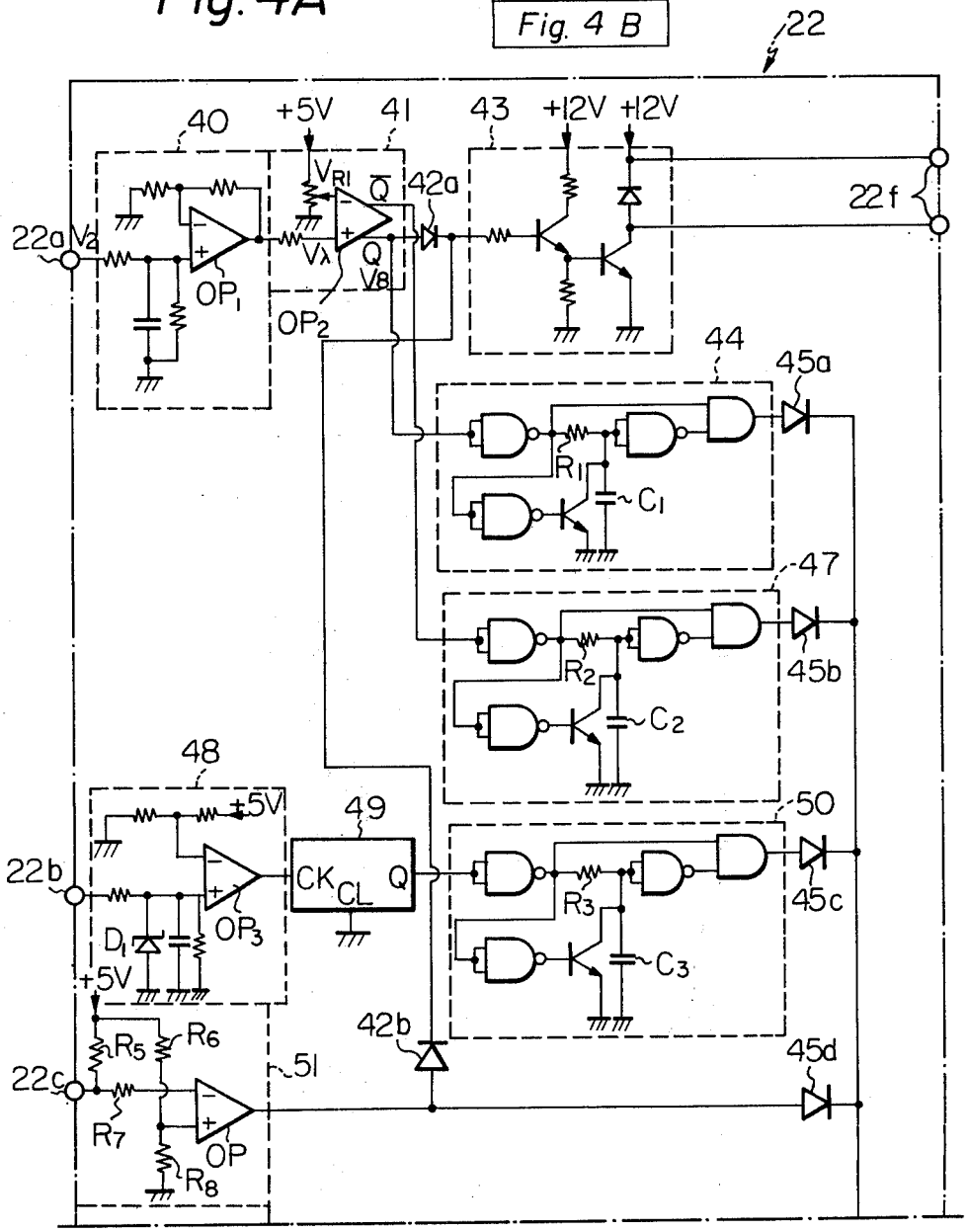
FIGS. 4*a* and 4*b* show a detailed circuit diagram of the control circuit shown in FIG. 3.
Figure 4B:
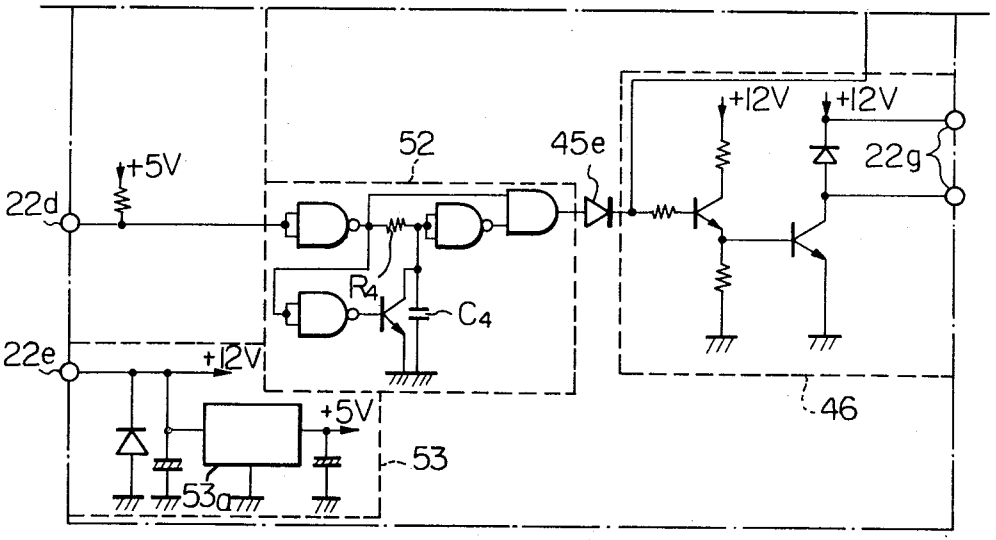

FIG. 4 is a detailed circuit diagram illustrating the control circuit 22 shown in FIG. 3. The structure and operation of the control circuit 22 will now be described in detail with reference to FIG. 4.

The voltage follow circuit 40 is a well-known circuit in which an operational amplifier $OP_1$ is used as a non-inverting amplifier having a gain equal to 1. This voltage follow circuit 40 is adapted for improving the operating characteristics of the comparator 41 and the accuracy of the comparison function of the comparator 41 by matching the output impedance of the air-fuel ratio sensor 24 with the input impedance of the comparator 41. However, this voltage follow circuit 40 may be omitted if the structure of the comparator 41 is appropriately arranged so that the input impedance of the comparator 41 can be matched with the output impedance of the air-fuel ratio sensor 24.

The comparator 41 is composed of an operational amplifier $OP_2$ with a non-inverting input terminal to which an input signal to be compared with is transmitted, and an inverting input terminal to which a reference voltage is transmitted. This operational amplifier $OP_2$ is composed of an operational amplifier, such as 760C, with a non-inverting output terminal, namely the output terminal Q, and an inverting output terminal, namely the output terminal $\overline{Q}$ which is complementally interconnected with the output terminal Q. The level of the reference voltage $V_{R1}$ is maintained at a predetermined voltage level of about 0.5 V. Therefore, when the level of the input signal $V_\lambda$ transmitted from the air-fuel ration sensor 24 via the input terminal 22*a* to the non-inverting input terminal is higher than the reference voltage level, high and low level output signals appear on the output terminals Q and $\overline{Q}$ respectively, and; when the level of the above-mentioned input signal is lower than the reference voltage level, low and high level output signals appear on the output terminals Q and $\overline{Q}$, respectively. It is well known that such as operational amplifier $OP_2$ can also be realized by a combination of a normal operational amplifier and a level inverting element.

Each of the driving circuits 43 and 46 comprises a pair of switching transistors, respectively. When a high level signal is applied to the input terminal of these driving circuits, the transistors become conductive, and thus, a source voltage of 12 V fed from the power supply circuit 53 appears at each of the output terminals 22*f* and 22 *g*, respectively.

Each of the first through fourth monostable multivibrators 44, 47, 50 and 53 has a known circuit structure which includes three NOT elements and an AND element. Namely, each monostable multivibrator shown in FIG. 4 generates a high level signal having a predetermined duration each time the level of the signal applied to the input terminal thereof is changed from a high level to a low level. This duration is determined by the time constant which is derived from the capacitance value of the each capacitors $C_1$ through $C_4$ and the resistance value of the each resistors $R_1$ through $R_4$. As is well-known, the monostable multivibrator of the control circuit 22 can be formed by using various circuits other than the circuit shown in FIG. 4.

The wave-form shaping circuit 48 is a known circuit for shaping the wave-form of pulse signals applied from the contact points 30 and for adjusting the voltage level of the pulse signals to a level required by the digital frequency divider 49. As shown in FIG. 4, this circuit 48 comprises a zener diode $D_1$ for clamping the voltage level of the pulse signal and an operational amplifier $OP_3$ used for a comparator.

The frequency divider 49 is composed of a well-known digital counting circuit, such as a binary counter. This divider 49 is used for dividing the frequency of the pulse signal fed from the contact points 30 and applied to the electromagnetic valve 19, because the frequency of the pulse is too high for directly controlling the electromagnetic valve 19.

The inverting circuit 51 is composed of an operational amplifier $OP_4$, resistors $R_5$ and $R_6$ of the same resistance value, and resistors $R_7$ and $R_8$ of the same resistance value. This inverting circuit 51 is used for obtaining an output voltage having a level which is an inversion of the level of the input voltage, and can be embodied by various circuits other than the circuit shown in FIG. 4. Furthermore, this inverting circuit 51 should be omitted in the case where an engine temperature switch connected to the input terminal 22*c*, which generates a level contrary to the output signal level of the engine temperature switch 27 according to the present embodiment, is used.

The power supply circuit 53 is arranged so as to feed the source voltage of 12 V, which is applied from the battery 28 to the driving circuits 43 and 46, and the voltage of 5 V, which is regulated by means of the constant voltage supply circuit 53*a*, to the above-mentioned voltage follow circuit 40, comparator 41, monostable multivibrators 44, 47, 50 and 52, wave-form shaping circuit 48, divider 49, and inverting circuit 51.

The operation of the apparatus of the present embodiment will now be described.

The operation of the apparatus occurring when the engine is in a normal operating condition will first be illustrated. In this case, since the opening degree of the throttle valve is less than a predetermined value, the throttle position switch 26 is thus opened. Furthermore, since the temperature of the engine coolant is high enough, the engine temperature switch 27 is also opened. Therefore, in this case, no other electrical signal is applied to the control circuit 22, except for electrical signals fed back from the air-fuel ratio sensor 24 and the contact points 30. Accordingly, the apparatus of the present embodiment is controlled only by these electrical signals provided from the air-fuel ratio sensor 24 and the contact points 30.

Figure 6:
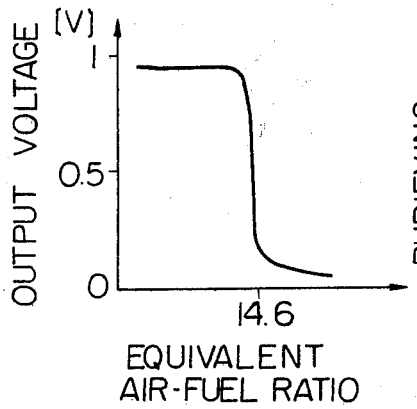
FIG. 6 is a graph illustrating the characteristics of an air-fuel ratio sensor shown in FIG. 1.

The air-fuel ratio sensor 24 of this embodiment is a well-known oxygen concentration sensor using zirconium oxide as an oxygen ion conductor. As shown in FIG. 6, the air-fuel ratio sensor 24 generates an output voltage of about 1 V when the equivalent air-fuel ratio is lower than the stoichiometric air-fuel ratio, namely, when the engine is maintained on the rich side of stoichiometric conditions. Furthermore, the sensor 24 generates an output voltage of about 0.1 to 0.2 V when the equivalent air-fuel ratio is higher than the stoichiometric air-fuel ratio, namely when the engine is maintained on the lean side of stoichiometric conditions.

Figure 5:
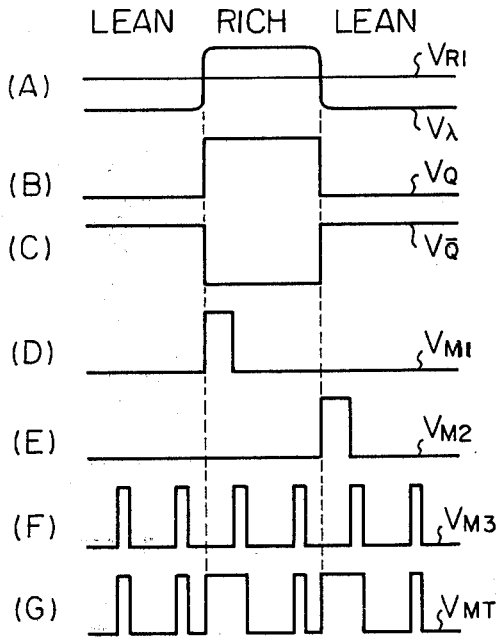
FIG. 5 shows waveforms obtained at various points in the control circuit shown in FIG. 4.

As shown in FIG. 5-(A), the output voltage $V_\lambda$ of the air-fuel ratio sensor 24 is applied to the comparator 41, via the voltage follow circuit 40 for matching the input impedance of the comparator 41 with the output impedance of the air-fuel ratio sensor 24, and the level of the output voltage $V_\lambda$ of the sensor 24 is compared with the level of the reference voltage $VR_1$. Thus, as shown in FIG. 5-(B), when a rich signal, which indicates that the equivalent air-fuel ratio is on the rich side of stoichiometric conditions, is generated, the level of the output signal $V_Q$ appearing at the output terminal Q of the comparator 41 becomes high. As a result, the driving circuit 43 is actuated to energize the electromagnetic valve 17. Furthermore, in this case, since the level of the output signal $V_{\bar{Q}}$ appearing at the output terminal $\bar{Q}$ becomes low, as shown in FIG. 5-(C), the second monostable multivibrator 47 is triggered at this negative edge of the output signal $V_{\bar{Q}}$ and a signal $V_{M1}$ shown in FIG. 5-(D) appears at the output terminal of the multivibrator 47. This output signal $V_{M1}$ is applied to the driving circuit 46.

The pulse signal, which is generated by the contact points 30 and has a frequency proportional to the rotational speed of the engine, is applied to the wave-form shaping circuit 48. After shaping the wave form, the pulse signal is applied to the frequency divider 49. The frequency division in the divider 49 is carried out by a division factor which is determined to correspond to the actuating speed of the electromagnetic valve 19. The output pulse of the frequency divider 49 is applied to the third monostable multivibrator 50. As a result, the multivibrator 50 generates a pulse signal $V_{M3}$, shown in FIG. 5-(F), with a frequency proportional to the rotational speed of the engine and with a predetermined pulse width. This pulse signal $V_{M3}$ is applied to the above-mentioned driving circuit 46. Thus, both of the output signals $V_{M1}$ and $V_{M3}$ of the respective monostable multivibrators 47 and 50 are applied to the driving circuit 46. In other words, a signal $V_{MT}$ shown in FIG. 5-(G) is applied to the driving circuit 46 and then the electromagnetic valve 19 is energized in accordance with the signal $V_{MT}$.

When the electromagnetic valve 17 is energized and the electromagnetic valve 19 is intermitently energized by the signal $V_{MT}$ shown in FIG. 5-(G), the actuating pressure, such as the vacuum pressure of the intake manifold 11 or the discharge pressure of the air pump 16, is applied to the diaphragm chamber of the air flow control valve 15 (15') via the orifice 21, the electromagnetic valves 17 and 19, and the orifice 18. Thus, the secondary air which is pushed by the air pump 16 is injected into the exhaust manifold 12 of the engine via the air flow control valve 15 and the secondary air manifold 14. In this case, since the on-off control of the valve 19 is carried out in accordance with the aforementioned signal $V_{MT}$, the air flow control valve 15 is instantly actuated in response to the signal fed from the air-fuel ratio sensor 24 without delay. Furthermore, the response speed of the valve 15 corresponds to the rotational speed of the engine.

Figure 8:
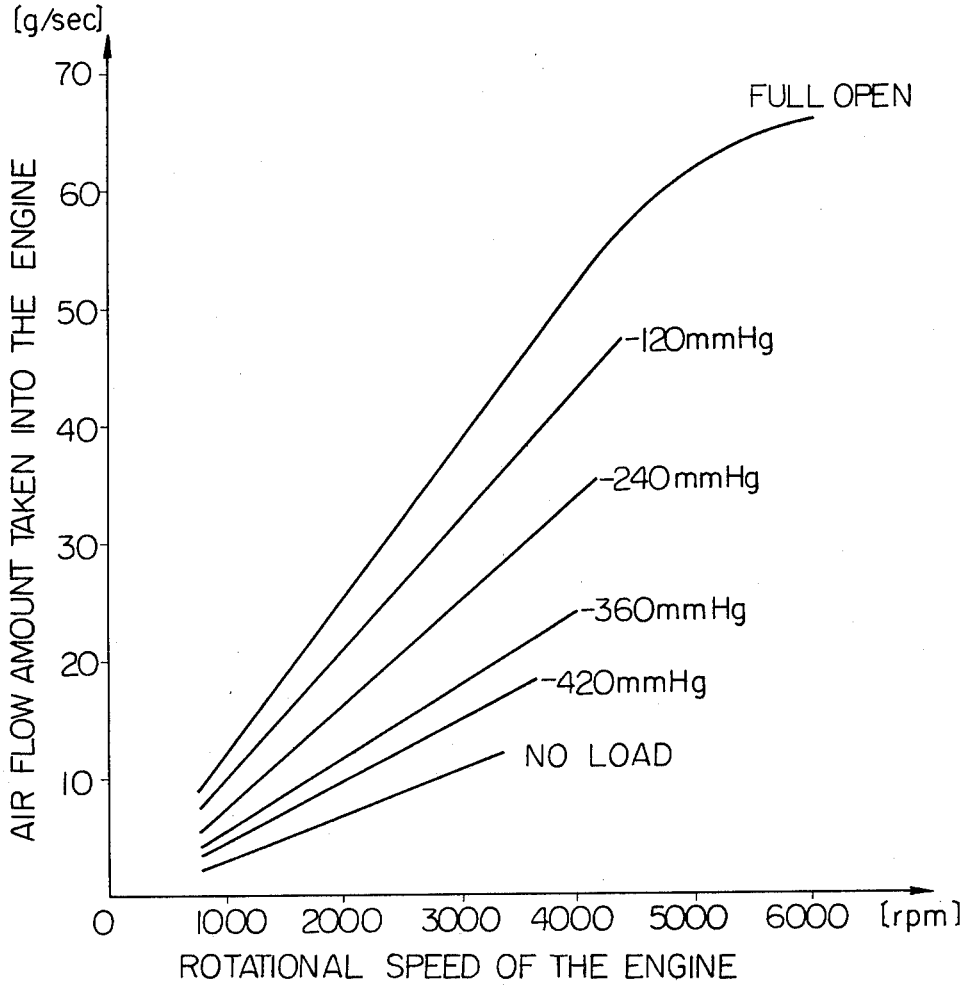
FIG. 8 is a graph illustrating the relation between the rotational speed of the engine and the air flow amount sucked into the engine.

Since there is a proportional relationship between the rotational speed of the engine and the air flow amount taken into the engine, as shown in FIG. 8, the response speed of the valve 15 is in proportion to the air amount taken into the engine, namely to the amount of the exhaust gas emitted from the engine. When the equivalent air-fuel ratio is controlled so that it is on the lean side, the output voltage $V_\lambda$ of the air-fuel ratio sensor 24 is changed to a low level (this is called a lean signal), which is lower than the level of the reference voltage $V_{R1}$, as shown in FIG. 5-(A), and the level of the output signal $V_Q$ of the comparator 41 is changed to low, as shown in FIG. 5-(B). Therefore, the electromagnetic valve 17 is de-energized and, furthermore, the first monostable multivibrator 44 generates an output signal $V_{M2}$ shown in FIG. 5-(E) at the negative edge of the output signal $V_Q$ of the comparator 41, to cause the electromagnetic valve 19 to be energized by the signal $V_{MT}$ shown in FIG. 5-(G). Thus, the pressure in the diaphragm chamber of the valve 15 or 15' changes from the negative pressure level or from the positive pressure level to the atmospheric pressure level. As a result, the valve 15 is actuated so as to discharge the secondary air, which is pushed by the air pump 16, into the atmosphere through, for example, an air cleaner (not shown), without injecting the secondary air into the exhaust manifold 12. In this case, the air flow control valve 15 is instantly actuated in response to the signal fed from the air-fuel ratio sensor 24 without delay and, furthermore, the response speed thereof corresponds to the amount of the exhaust gas emitted from the engine, in the same manner as described before.

As described above, the apparatus according to the present embodiment is constructed so that the air flow control valve 15 is controlled so that it has a response speed corresponding to the amount of the exhaust gas emitted from the engine and is instantly actuated in response to the level change of the signal fed from the air-fuel ratio sensor 24. Therefore, the secondary air is correctly injected into the engine without delay and, as a result, the equivalent air-fuel ratio can be always maintained within a desired range.

When the opening degree of the throttle valve exceeds the predetermined value due to, for example, the rapid accelaration of the engine, the throttle position switch 26 is closed to cause the fourth monostable multivibrator 52 to produce a high level signal with a predetermined duration. The driving circuit 46 is actuated by this signal produced by the fourth monostable multivibrator 52 to energize the electromagnetic valve 19. On the other hand, since the equivalent air-fuel ratio rapidly changes to the rich side of the stoichiometric air-fuel ratio when the throttle valve is widely opened the electromagnetic valve 17 is maintained in the energized condition. As a result, secondary air is rapidly injected into the exhaust manifold 12 in the same manner as in the above-mentioned case. Namely, even if the opening degree of the throttle valve exceeds the predetermined value and the air-fuel ratio of the air-fuel mixture fed into the cylinder of the engine is rapidly changed to be on the rich side of the stoichiometric air-fuel ratio, the equivalent air-fuel ratio will be controlled within the predetermined range without any delay.

Figure 7:
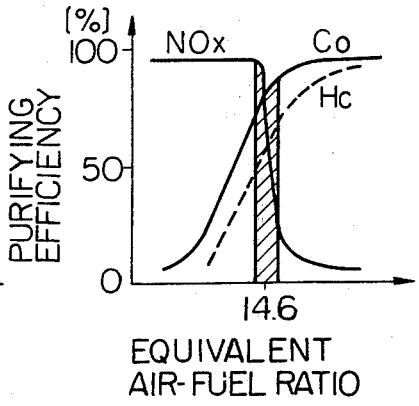
FIG. 7 is a graph illustrating the characteristics of a three-way catalytic converter shown in FIG. 1.

Accordingly, the three-way catalytic converter 25 mounted on the exhaust pipe 23 can be used to effectively purify the pollutants not only when the engine is normally operated, but also when the engine is rapidly accelerated. This is because the three-way catalytic converter has operating characteristics as shown in FIG. 7, which illustrates the relationship between the purifying efficiency of the three-way catalytic converter and the equivalent air-fuel ratio. As shown in FIG. 7, the three-way catalytic converter can attain the highest efficiency in simultaneously purifying the three main harmful pollutants in the exhaust gas when the equivalent air-fuel ratio is within a very narrow range (shown as the hatched zone in FIG. 7) which is near the stoichiometric air-fuel ratio.

The operation of the apparatus of the present embodiment occurring when the temperature of the engine coolant is lower than a predetermined value, for example 50° C., and occurring when the engine temperature switch 27 is closed is now illustrated.

In this case, since a low level signal is applied to the inverting circuit 51, the level of the output voltage of the inverting circuit 51 is maintained at a high level. As a result, the driving circuits 43 and 46 are actuated to energize the electromagnetic valves 17 and 19. Therefore, in this case, secondary air is injected into the exhaust manifold 12 in the same manner as described above. When the temperature of the coolant exceeds the predetermined value, the engine temperature switch 27 is opened and the operation of injecting secondary air into the engine in response to the temperature of the coolant is stopped. Thereafter, control of the secondary air injection is performed in accordance with the signals generated from the air-fuel ratio sensor 24 and from the throttle position switch 26. As described above, the present apparatus is arranged so that when the engine temperature is low, the equivalent air-fuel ratio is forcibly controlled so that it is on the lean side by injecting secondary air into the exhaust gas. Accordingly, in this case, the three-way catalytic converter acts as an oxidation catalytic converter, and the CO and HC components in the exhaust gas are thereby effectively reduced. This is because when the engine temperature is low, since the air-fuel ratio sensor is inactive, the air-fuel feedback control based on the signal generated from the air-fuel ratio sensor cannot be performed. Furthermore, in this case, the temperature of the catalytic converter is low and the amount of the $NO_X$ component contained in the exhaust gas is very small.

As will be apparent from the foregoing description, since the apparatus for controlling the amount of secondary air fed into the engine according to the present invention comprises means for controlling the level of the actuating pressure applied to the means for controlling the amount of secondary air fed into the engine, in accordance with the amount of the exhaust gas emitted from the engine, the response speed of the secondary air flow control means is controlled in accordance with the amount of the exhaust gas emitted from the engine. As a result, the equivalent air-fuel ratio can be controlled precisely in response to changes in the operating condition of the engine, without delay. Furthermore, since the apparatus according to the present invention also comprises means for applying the actuating pressure to the secondary air flow control means when the level of the signal generated by the air-fuel ratio sensor changes, the equivalent air-fuel ratio can be controlled more precisely and without delay.

Accordingly, the purifying efficiency of the three-way catalytic converter can be remarkably improved. Furthermore, the apparatus according to the present invention is advantageous in that its structure is very simple and its manufacturing cost is very low.

In the above described embodiment, the rotational speed detecting means is used for detecting the amount of the exhaust gas emitted from the engine. However, in some embodiments, means for detecting the vacuum pressure level in the intake manifold of the engine, or means for detecting the amount of air taken into the engine, may be used instead of the rotational speed detecting means.

As many widely different embodiments of the present invention may be constructed without departing from the spirit and scope of the present invention, it should be understood that the present invention is not limited to the specific embodiments described in this specification, except as defined in the appended claims.

What is claimed is:

1. An apparatus for controlling the amount of secondary air fed into an internal combustion engine, said apparatus comprising:

means for generating a first electrical signal having two voltage levels which are selected in accordance with an air-fuel ratio condition of said engine;

means for generating second electrical signals having a predetermined pulse duration and having a frequency which is proportional to the rotational speed of said engine;

an air control valve having a control chamber to which a pneumatic pressure signal is applied, said valve, responding to the pressure level in said control chamber, controlling the amount of secondary air to be fed into said engine;

a single first switching valve responding to the voltage level of said first electrical signal, for generating a pneumatic pressure signal by selectively communicating said control chamber of said air control valve with a pneumatic pressure source and with the atmosphere; and a single second switching valve connected between said control chamber of said air control valve and said first switching valve, said second switching valve intermittently transmitting said pneumatic pressure signal from said first switching valve to said control chamber in response to said second electrical signals.

2. An apparatus as claimed in claim 1, wherein said apparatus further comprises means for generating third electrical signals at the negative edge and the positive edge of said first electrical signal, said third electrical signals having a predetermined duration, and said second switching valve intermittently transmits said pneumatic pressure signal from said first switching valve to said control chamber in response to both of said second electrical signals and said third electrical signals.

3. An apparatus as claimed in claim 1, wherein said first switching valve increases the pressure level of said pneumatic pressure signal when the level of said first electrical signal indicates a rich condition of said engine, and decreases the pressure level of said pneumatic pressure signal when the level of said first electrical signal indicates a lean condition of said engine.

4. An apparatus as claimed in claim 1, wherein said engine has an air pump for driving secondary air and said air control valve controls the amount air fed from said air pump to said engine.

5. An apparatus as claimed in claim 1, wherein said means for generating a first electrical signal comprises an air-fuel ratio sensor for selectively generating an electrical signal having two voltage levels in response to the concentration value of a predetermined constituent in said exhaust gas, and a comparator for comparing the level of said generated electrical signal of said air-fuel ratio sensor with a predetermined reference voltage.

6. An apparatus as claimed in claim 1, wherein said pneumatic pressure source is an intake manifold of said engine.

7. An apparatus as claimed in claim 1, wherein said engine has an air pump for driving secondary air, and said pneumatic pressure source is the air pump.

8. An apparatus as claimed in claim 1, wherein said engine has at least one throttle valve, and said apparatus further comprises means for generating a fourth electrical signal which indicates that the opening degree of said throttle valve is higher than a predetermined value, and means for rapidly increasing said pneumatic pressure to said air control valve, in response to said fourth electrical signal.

9. An apparatus as claimed in claim 1, wherein said apparatus further comprises means for generating a fifth electrical signal which indicates that the temperature of said engine is lower than a predetermined level, and means for applying said pneumatic pressure to said air control valve when said fifth electrical signal is applied thereto.

* * * * *